US006957860B1

(12) United States Patent
Leist et al.

(10) Patent No.: US 6,957,860 B1
(45) Date of Patent: Oct. 25, 2005

(54) STACKABLE CHAIR WITH GLIDES

(75) Inventors: LeRon Leist, Muscatine, IA (US); James M. Groulx, Muscatine, IA (US); Randall E. Green, Muscatine, IA (US); Eric Bastin, Muscatine, IA (US)

(73) Assignee: HNI Technologies Inc., Muscatine, IA (US)

( * ) Notice: Subject to any disclaimer, the term of this patent is extended or adjusted under 35 U.S.C. 154(b) by 0 days.

(21) Appl. No.: 10/865,192

(22) Filed: Jun. 10, 2004

(51) Int. Cl.[7] ..... A47C 3/04
(52) U.S. Cl. ..... 297/239; 297/448.2
(58) Field of Search ..... 16/42 R, 42 T, 16/18 R, 30, 404; 297/448.2, 448.1, 239, 297/463.1, 463.2, 232, DIG. 2; 248/188.9, 248/188.1, 188.8, 345.1

(56) References Cited

U.S. PATENT DOCUMENTS 2,301,420 A * 11/1942 Liabastre ..... 248/188.9
2,921,760 A * 1/1960 Wheeler ..... 248/615
3,724,897 A * 4/1973 Faiks et al. ..... 297/447.3
5,064,247 A * 11/1991 Clark et al. ..... 297/447.3
5,820,217 A * 10/1998 Horner et al. ..... 297/344.11
6,626,405 B1 * 9/2003 Keast et al. ..... 248/188.9
6,866,338 B2 * 3/2005 Mendenhall et al. ..... 297/239
2005/0115022 A1 * 6/2005 Desmarais ..... 16/42 R

FOREIGN PATENT DOCUMENTS

DE 3829282 * 3/1990

* cited by examiner

*Primary Examiner*—Milton Nelson, Jr.
(74) *Attorney, Agent, or Firm*—Ronald A. Sandler; Jones Day

(57) ABSTRACT

A stackable chair having a support structure and a seat and a back mounted to the support structure. The support structure includes two horizontally extending runner portions, each with two pairs of grooves. Mounted to the runner portions and engaged with the pairs of grooves are four glides. Each glide includes two arms and a base and a recess in the base. The arms each have a horizontally extending rib projecting inwardly so as to engage the grooves. Molded into each glide at the recess is a hard industrial felt member.

19 Claims, 4 Drawing Sheets

12
10
20
14
18
16
44
46
42
52
64
40
50
62
66
60

10
12
14
18
32
26
22
24
16
46
40
50
62
60

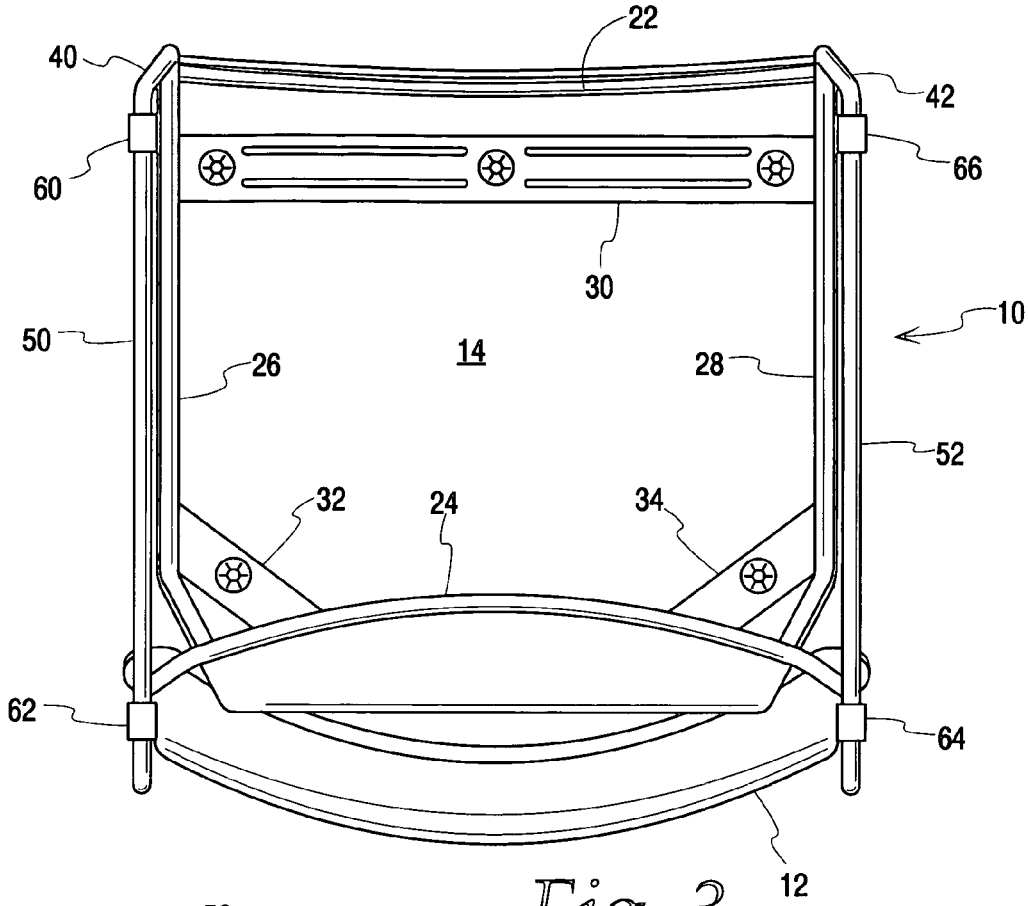
Fig. 3
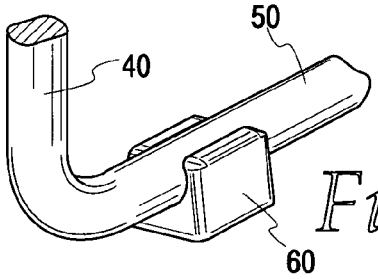
Fig. 4
Fig. 5
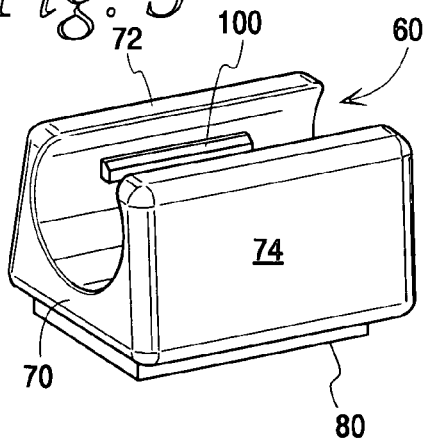
Fig. 6
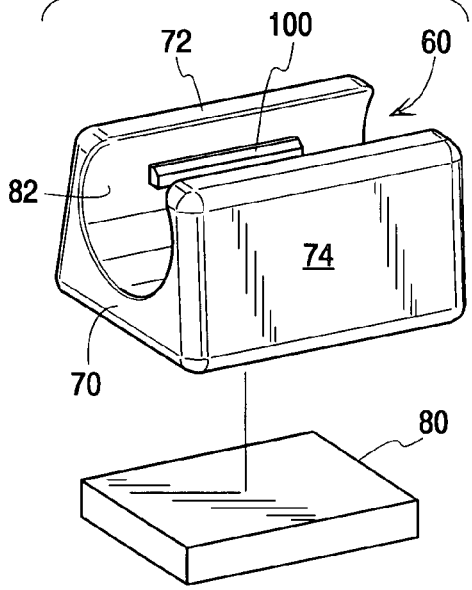

STACKABLE CHAIR WITH GLIDES

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates to a stackable chair with glides and more particularly to a stackable chair with glides having a hard felt bottom to prevent scratching of floor surfaces.

2. Description of the Related Art

Stackable chairs are used throughout industry, the professions and especially the hotel field, and anywhere when there is a need to provide quick, easy and convenient seating for small or large groups of people. Stackable chairs are typically simply constructed and relatively inexpensive. Such chairs are often provided with glides along bottom runners to ease movement of the chair by a user.

Glides are usually made of a hard plastic material and these often pick up dirt particles that embed themselves in the lower surface of the glides. These dirt particles tend to remain in the glides and will thereafter cause scratches on floor surfaces on which the chair is placed.

BRIEF SUMMARY OF THE INVENTION

The difficulty encountered with previous devices have been overcome by the present invention. What is described here is a stackable chair including a back, a seat, a support to which the back and seat are mounted, the support including two horizontally extending runners, a first glide mounted to one of the two horizontal runners, a second glide mounted to the other of the two horizontal runners, where each of the glides has a generally U-shaped configuration including a base and two upwardly extending and converging arms, the base having a bottom recess, and a felt polyhedron molded into the base.

There are a number of advantages, features and objects achieved with the present invention which are believed not to be available in earlier related devices. For example, the present invention provides simply constructed, robust and relatively inexpensive stackable chairs. These chairs are reliable, and include felt bottom glides which will not come apart and which minimize dirt particle pick up.

A complete understanding of the present invention and other objects, advantages and features thereof will be gained from a consideration of the present specification which provides a written description of the invention, and of the manner and process of making and using the invention, set forth in such full, concise, and exact terms as to enable any person skilled in the art to which it pertains, or with which it is most nearly connected to make and use the same in compliance with Title 35 U.S.C. §112 (first paragraph). Furthermore, the following description of a preferred embodiment of the invention read in conjunction with the accompanying drawing provided herein represents an example of the invention in compliance with Title 35 U.S.C. §112 (first paragraph), but the invention itself is defined in the claims section attached hereto.

BRIEF DESCRIPTION OF THE SEVERAL VIEWS OF THE DRAWING

FIG. 3 is a bottom plan view of the stackable chair.

FIG. 4 is an enlarged isometric view of a portion of the stackable chair illustrating a glide.

FIG. 5 is an isometric view of the glide.

FIG. 6 is an exploded, enlarged isometric view of the glide and of a felt member.

DETAILED DESCRIPTION OF A PREFERRED EMBODIMENT OF THE INVENTION

Figure 1:
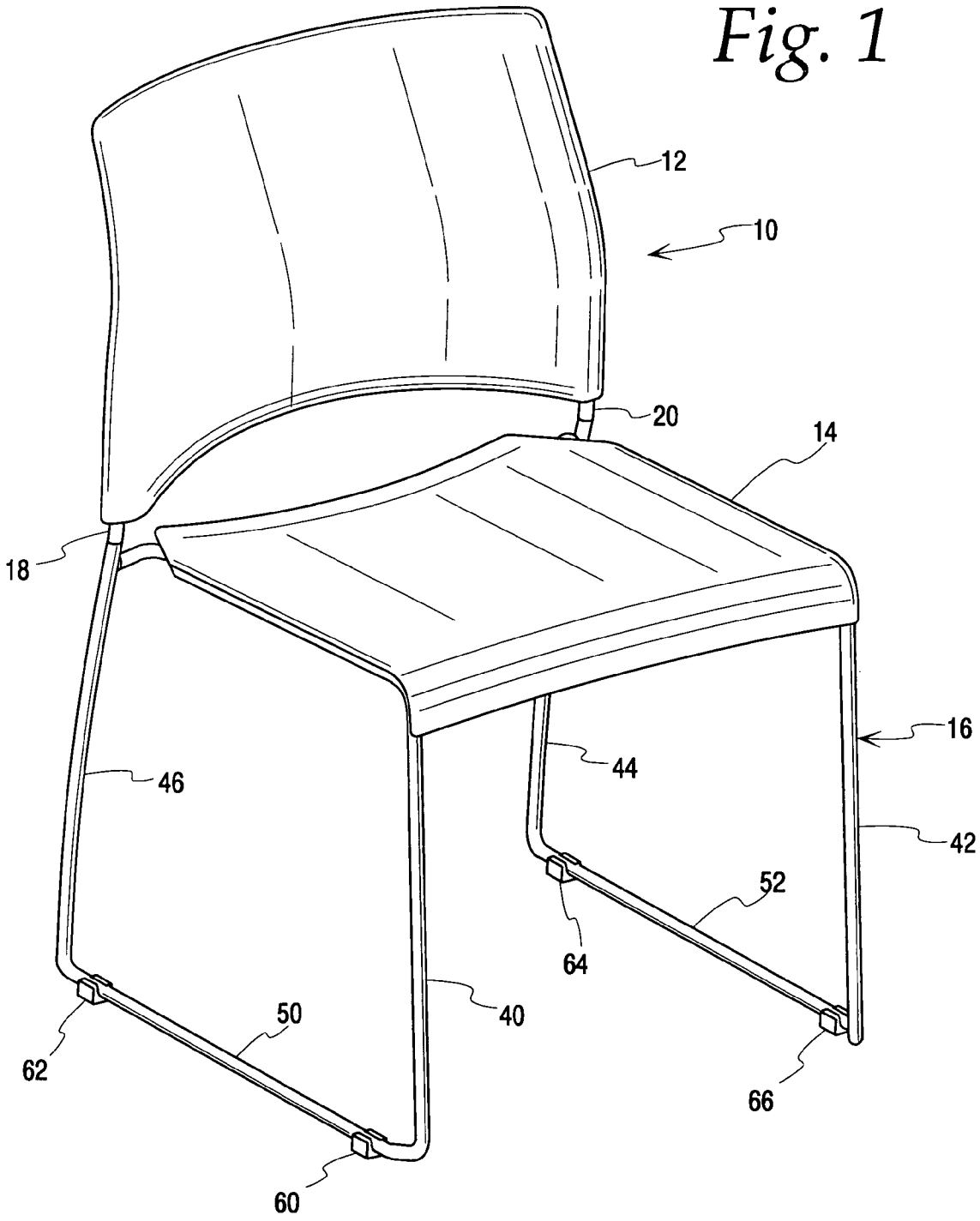
FIG. 1 is a right side downward looking isometric view of a stackable chair.

While the present invention is open to various modifications and alternative constructions, the preferred embodiment illustrating the best mode contemplated by the inventors of carrying out their invention is shown in the various figures of the drawing will be described herein in detail, pursuant to Title 35 U.S.C. §112 (first paragraph). It is understood, however, that there is no intention to limit the invention to the particular embodiment, form or example which is disclosed herein. To the contrary, the intention is to cover all modifications, equivalent structures and methods, and alternative constructions falling within the spirit and scope of the invention as expressed in the appended claims section attached hereto, pursuant to Title 35 U.S.C. §112 (second paragraph).

Figure 2:
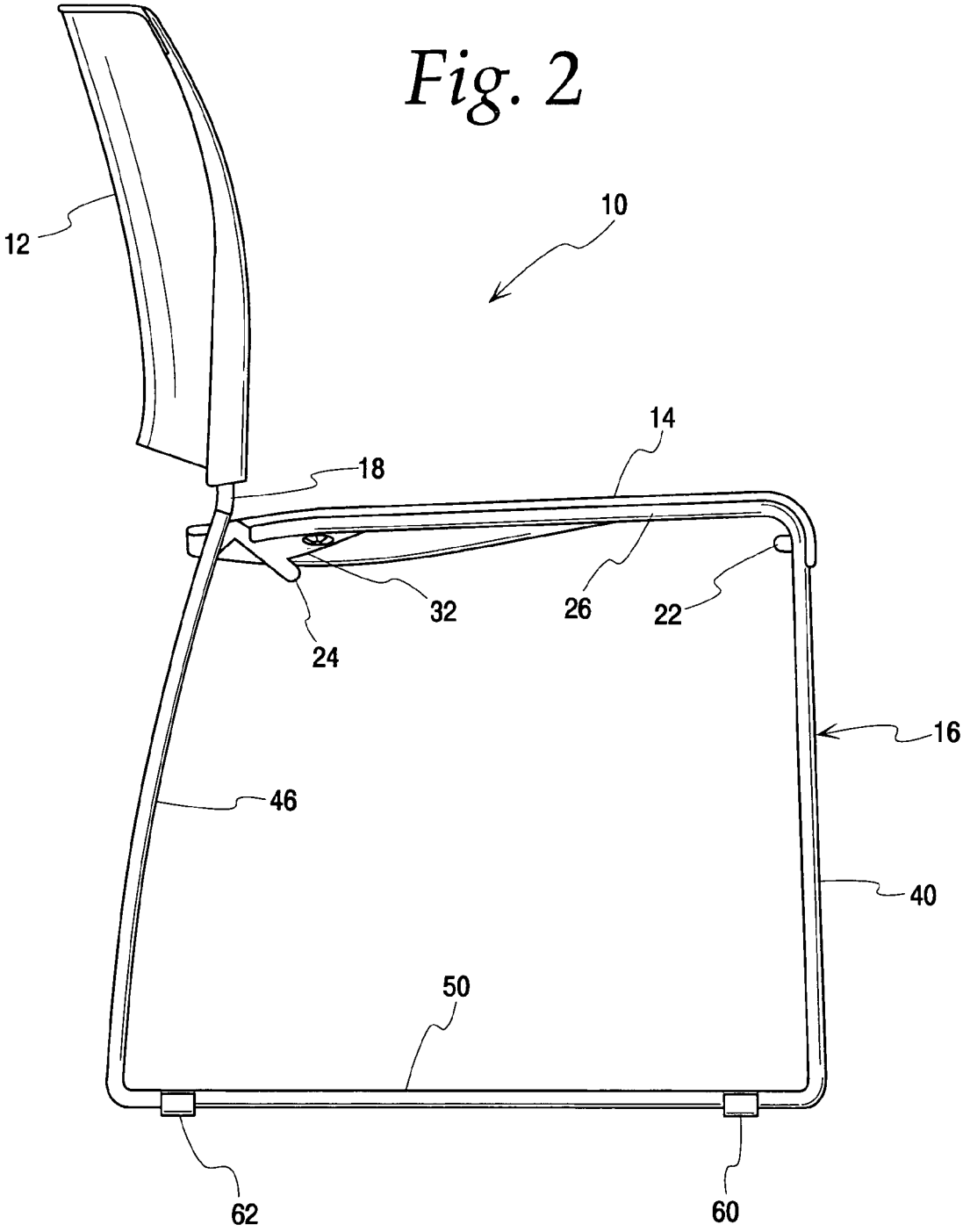
FIG. 2 is a right side elevation view of the stackable chair.
Figure 8:
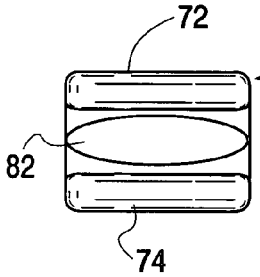
FIG. 8 is a top plan view of the glide.
Figure 7:
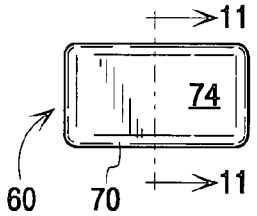
FIG. 7 is a side elevation view of the glide.
Figure 10:
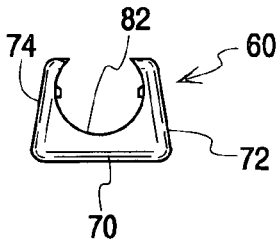
FIG. 10 is a front elevation view of the glide.
Figure 11:
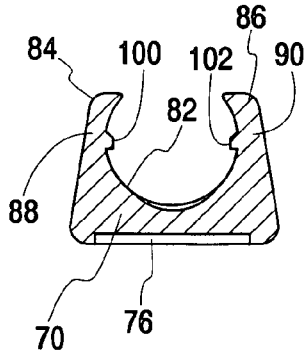
FIG. 11 is a section view taken along line 11—11 of FIG. 7.
Figure 9:
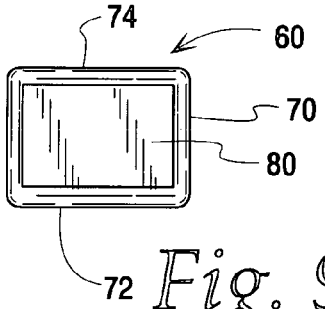
FIG. 9 is a bottom plan view of the glide.

Referring to FIGS. 1–3, there is illustrated a stackable chair 10 having a back 12, a seat 14 and a support 16 which mounts both the back and the seat. The support includes two upstanding portions 18, 20 to which the back is attached and four horizontal portions 22, 24, 26, 28. Mounted to the four horizontal portions are three strip members 30, 32, 34 to which the seat is mounted. The support further includes four vertical leg portions 40, 42, 44, 46 and two horizontal runner portions 50, 52. Four glides 60, 62, 64, 66 are attached to the runner portions of the support.

Referring to FIG. 4, there is illustrated an intersection of the runner portion 50 and the leg portion 40 and the front glide 60 connected to the runner portion. The glides facilitate a user's ability to slide the chair 10 backward and forward on a hard floor surface, such as wood, polished concrete, vinyl or tile.

Referring now to FIGS. 5–11, the glide 60 is shown in more detail. The glide has a generally U-shaped configuration and includes a base 70 and two upwardly extending arms 72, 74. It is noted that the arms converge at an angle of approximately 15.6 degrees.

The base includes a recess 76 which is to receive a polyhedron shaped felt member 80. FIGS. 8–11 show the glide 60 without the felt member 80. The base and the arms in cross section form an interior circular configuration, defined by an inner surface 82, extending through an arc of approximately two hundred seventy-eight degrees and leaving an upper open end of approximately eighty-two degrees. This configuration allows upper portions 84, 86 of the arms to have larger dimensions than middle portions 88, 90 of the two arms.

The circular sectional configuration of the glides match closely the sectional configuration of each of the runner portions of the support 16.

Figure 12:
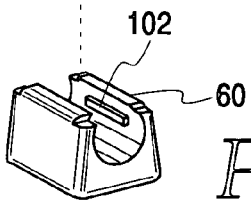
FIG. 12 is an exploded isometric view showing the glide and a portion of the stackable chair.

Located on the inner surface 82 of the glide are two horizontally extending ribs 100, 102 which extend inwardly. These ribs are structured to engage a complementing pair of grooves 104, 106 formed in the runners, such as shown in FIG. 12. The rib and groove combination aligns the glide properly relative to the runner and ensures that once the glide snaps over the runner, there is an interference fit created so that the glide will not inadvertently fall off the stackable chair when it is moved around, nor will the glide slide along the runner portion in the direction of the longitudinal axis of the runner portion. Each runner portion has two pairs of grooves at the locations of the four glides shown in FIG. 1.

Figure 13:
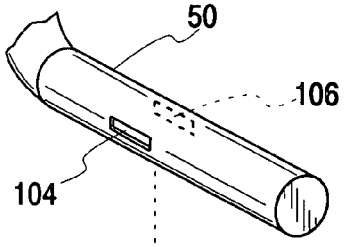
FIG. 13 is a front view of the felt member.
Figure 13:
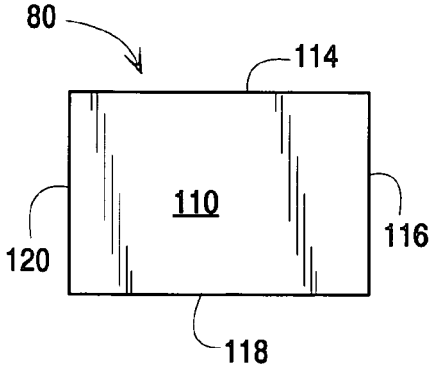
Figure 14:
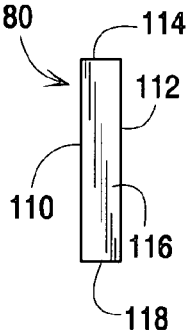
FIG. 14 is a side elevation view of the felt member.

Referring now to FIGS. 13 and 14, the felt floor engaging member 80 has a polyhedron shape where each of the sides 110, 112, 114, 116, 118, 120 are in the form of rectangles. The felt member is formed of a grade designated F3 which is well known by those skilled in the art. Grade F3 industrial felt is relatively hard but not as hard as the plastic material of the glide which may be made of polycarbonate. Thus, dirt particles might be picked up by the felt member but the particles will become fully embedded in the felt and not protrude outwardly or they will fall away. If only hard plastic is used, a portion of the dirt particle remains on the surface and thus, tends to be trapped between the plastic and a floor on which the chair is located and when the chair is moved, the dirt particle tends to scratch such floor surfaces as polished concrete, vinyl, wood and tile.

Another advantage of F3 grade industrial felt is that it may be molded into the glide rather than attached by an adhesive. The molding operation entails heating the glide and then applying the felt member with pressure. This arrangement securely fastens the felt member to the glide and is considered to be permanent. Thus, solvents will not release the bond of the felt member to the glide as might be the case if an adhesive is used.

Each of the glides 60, 62, 64, 66 are identically formed.

In operation, the glides with the molded felt members are easily and quickly snap fitted to the runner portions of the stackable chairs in the four locations shown in FIG. 1. The arms of the glides are flexible so that they will expand outwardly upon insertion and then have a memory to return to the position shown in FIG. 10 which is more than three quarters of the way around the circumference of the runner portions and in addition, there is the engagement of the ribs and the grooves.

The above specification describes in detail a preferred embodiment of the present invention. Other examples, embodiments, modifications and variations will, under both the literal claim language and the doctrine of equivalents, come within the scope of the invention defined by the appended claims. For example, making slight changes to the shape of the runners and the shape of the glide or the shape of the felt member will all be considered equivalent structures and will also come within the literal language of the claims. Still other alternatives will also be equivalent as will many new technologies. There is no desire or intention here to limit in any way the application of the doctrine of equivalents nor to limit or restrict the scope of the invention.

What is claimed is:

1. A stackable chair comprising:

a back;

a seat;

a support to which said back and said seat are mounted, said support including two horizontally extending runner portions;

a first glide mounted to one of said two horizontal runner portions;

a second glide mounted to the other of said two horizontal runner portions, each of said glides having a generally U-shaped configuration including a base and two upwardly extending and converging arms, said base having a bottom recess; and a polyhedron shaped felt member molded into said base at said bottom recess.

2. The stackable chair of claim 1 wherein:

said felt has a hardness level of F3.

3. The stackable chair of claim 1 wherein:

each of said glides has an interior circular cross section.

4. The stackable chair of claim 3 wherein:

said circular cross section extends through an arc of about 278 degrees.

5. The stackable chair of claim 1 wherein:

end portions of said arms have greater dimensions than mid portions of said arms.

6. The stackable chair of claim 5 wherein:

each of said glides has an interior circular cross section.

7. The stackable chair of claim 6 wherein:

said felt has a hardness level of F3.

8. The stackable chair of claim 7 wherein:

said circular cross section extends through an arc of about 278 degrees.

9. The stackable chair of claim 8 wherein:

end portions of said arms have greater dimensions than mid portions of said arms.

10. The stackable chair of claim 1 wherein:

each horizontally extending runner portion includes a pair of oppositely disposed grooves.

11. The stackable chair of claim 10 wherein:

each of said first and said second glides includes a horizontally disposed rib extending inwardly from each of said arms to engage said grooves in said runner portions.

12. The stackable chair of claim 11 wherein:

said felt has a hardness level of F3.

13. The stackable chair of claim 12 wherein:

each of said glides has an interior circular cross section.

14. The stackable chair of claim 13 wherein:

said circular cross section extends through an arc of about 278 degrees.

15. The stackable chair of claim 14 wherein:

end portions of said arms have greater dimensions than mid portions of said arms.

16. The stackable chair of claim 15 wherein:

said arms converge at an angle of about 15.6 degrees.

17. The stackable chair of claim 16 wherein:

said felt member has six sides, each having a rectangular shape.

18. The stackable chair of claim 1 wherein:

said felt member has six sides, each of rectangular shape.

19. The stackable chair of claim 1 wherein:

said arms converge at an angle of about 15.6 degrees.

* * * * *